US005551345A

United States Patent [19]

Wardecki et al.

[11] Patent Number: 5,551,345

[45] Date of Patent: Sep. 3, 1996

[54] DUAL-CHARGE SMOKE SCREEN SHELL

[75] Inventors: Norbert Wardecki, Heuweiler; Herwig Feldmeier, March, both of Germany

[73] Assignees: Buck-Werke GmbH & Co., Bad Ueberkingen, Germany; SM Schweizerische Munitionsunternehmung, Thun, Switzerland

[21] Appl. No.: 333,632

[22] Filed: Nov. 3, 1994

[30] Foreign Application Priority Data

Nov. 4, 1993 [DE] Germany ..... 43 37 680.0

[51] Int. Cl.[6] ..... F42B 4/28

[52] U.S. Cl. ..... 102/340; 102/342; 102/351; 102/357; 102/360

[58] Field of Search ..... 102/334, 340, 102/342, 351, 357, 360, 505

[56] References Cited

U.S. PATENT DOCUMENTS

| | | | |
|---|---|---|---|
| 4,436,034 | 3/1984 | Jacobsen et al. | 102/334 |
| 4,697,521 | 10/1987 | Espagnacq et al. | 102/334 |
| 4,726,295 | 2/1988 | Embury, Jr. et al. | 102/334 |
| 4,791,870 | 12/1988 | Simpson et al. | 102/342 |
| 4,838,167 | 6/1989 | Prahauser et al. | 102/334 |
| 4,860,657 | 8/1989 | Steinicke et al. | 102/334 |
| 5,272,981 | 12/1993 | Badura et al. | 102/370 |
| 5,390,605 | 2/1995 | Meili et al. | 102/336 |
| 5,445,078 | 8/1995 | Marion | 102/505 |

FOREIGN PATENT DOCUMENTS

| | | |
|---|---|---|
| 2830119 | 1/1980 | Germany . |
| 3035799 | 4/1981 | Germany . |
| 3844300 | 7/1990 | Germany . |
| 3841649 | 9/1990 | Germany . |
| 4125355 | 1/1993 | Germany . |

OTHER PUBLICATIONS

Norwegian Article (stamped index No. R 8000), "Instantaneous Smoke Screening Systems", by Kjell O. Jacobsen.

*Primary Examiner*—Peter A. Nelson
*Attorney, Agent, or Firm*—Hill, Steadman & Simpson

[57] ABSTRACT

A smoke screen shell is provided having a rapidly burning decoy charge that generates a spontaneous fog and a slowly burning camouflage charge that generates a lasting fog. The decoy charge and camouflage charge are fired from a canister sleeve by an ejection charge. Upon firing, pressure from the ejection charge is communicated through a channel to a relief chamber positioned between the decoy charge and the camouflage charge. This results in an accelleration difference, causing a separation and slightly different trajectories, the decoy component accelerating at a higher rate. The decoy charge takes effect in the air prior to the camouflage charge. The collocation of the spontaneous fog and of the lasting fog essentially occurs in the target. The decoy charge and the camouflage charge land within a proximity at a target area such that a collocation occurs between the spontaneous fog and of the delayed lasting fog. The ignition and relief chambers, the channel therebetween, the charges, etc. are dimensioned and configured to assure the desired proximal collocation without a mechanical connection between the camouflage charge and the decoy charge.

20 Claims, 3 Drawing Sheets

DUAL-CHARGE SMOKE SCREEN SHELL

BACKGROUND OF THE INVENTION

The present invention generally relates to a smoke screen shell. More particularly, the present invention relates to a smoke screen shell for discharging a rapidly burning component or decoy charge that produces a spontaneous fog and a slowly burning component or camouflage charge that produces a lasting fog. The present smoke screen shell has an ignition system for igniting an ejection charge, the decoy charge and the camouflage charge, whereby the decoy charge takes effect in the air before the camouflage charge after the initiation of the smoke screen shell, and a collocation of the spontaneous fog and the lasting fog essentially occurs in the target.

Smoke screening is a tactical and operational measure that is often employed where there is a need for an infrared-masking fog, such as for the protection of a tank or other vehicle. This is realizable by providing two pyrotechnic components. A decoy charge is reacted first for an immediate masking of the vehicle to be protected, creating a spontaneous fog. A camouflage charge is also reacted to deploy a longer-lasting fog. The decoy charge must take effect as soon as possible and the camouflage charge must take effect with delayed timing within the proximity of the decoy charge. Thus the smoke screen shell must be adapted to ignite the two components in a chronologically delayed fashion for effecting the functional sequence of each component. Furthermore, the smoke screen shell must be configured to project the components at a desired spatial proximity from each other.

DE 41 25 355 C1, for example, discloses a smoke screen shell of the type described above, wherein a grappling line system makes it possible for the decoy charge land with the camouflage charge. After being fired from an ejector member, the decoy and camouflage charges remain tethered to the firing location via a grappling line whose length corresponds to the desired firing distance. The line is pulled taut when the desired firing distance has been reached, thereby mechanically igniting a propellant charge, resulting in a deployment of the decoy charge and subsequent deployment of the camouflage charge after well-defined delay time. However, a grappling line system is disadvantageous because it is not redeployable due to lack of space, particularly when configured for small caliber munitions such as 76 mm or 66 mm.

Both DE 30 35 799 C2 and Norwegian Letters Patent R 8000 disclose two-component smoke screen shells wherein a decoy charge is fired from a launcher tube chronologically before a camouflage charge, and the decoy charge is deployed closer to the firing location than the camouflage charge, in spatial terms, so that no collocation of the spontaneous fog and of the lasting fog occurs. The smoke screen shells of these two publications achieve enhanced functional reliability when used in moist or damp conditions.

Furthermore, DE 38 44 300 A1 discloses a single-component smoke screen shell which has a elongated tube that can be inserted into an ejector canister and from which active material can be fired. The elongated tube thus forms a secondary ejector canister, preventing contamination and damage to the actual ejector. The elongated tube also allows greater quantities of active material to be fired in the same range, and the power of recoil is reduced due to the internal ballistic properties of the elongated tube.

SUMMARY OF THE INVENTION

An object of the present invention is to provide a smoke screen shell that overcomes the disadvantages of the prior art smoke screen shells. Another object of the present invention is to provide an improved smoke screen shell whose functional sequence can be chronologically and spatially exactly adapted so that a collocation of spontaneous fog and lasting fog occurs. Furthermore, an object of the present invention is to provide a smoke screen shell which prevents contamination and damage to an ejector member.

For achieving these objects, the smoke screen shell of the invention is characterized in that a relief chamber is disposed between a decoy charge and a camouflage charge. The relief chamber is in communication with a first ignition chamber adjoining the ejection charge via a first channel. Pressure arising upon ignition of the ejection charge thereby causes a separation of the decoy charge from the camouflage charge resulting in a relative difference between the ballistic path of the decoy charge and the ballistic path of the camouflage charge.

In an embodiment, a diameter of the first channel is configured relative to a volume of the first ignition chamber and the relief chamber such that, after firing, the decoy charge is accelerated relative to the camouflage charge by a predetermined factor.

In an embodiment, a separating charge is provided, between the decoy charge and the camouflage charge. The separating charge can be initiated via the ignition system such that it accelerates the decoy charge relative to the camouflage charge.

In another embodiment, the camouflage charge and the decoy charge are configured to have selected drag coefficients such that the decoy charge flies faster than the camouflage charge after firing.

In a preferred embodiment, the camouflage charge has a braking mechanism such as extensible wings or the like.

Another preferred embodiment of the invention provides a contact head and an elongated sleeve connected to the contact head. The contact head and the sleeve can be introduced into a main ejector canister to form a secondary ejector canister from which the decoy charge and the camouflage charge are fired upon transmission of an ignition pulse to the contact head, whereas the contact head and the sleeve remain in the main ejector canister.

In an embodiment, the sleeve generally terminates with the decoy charge at the end of the sleeve opposite the contact head, surrounding all essential components of the smoke screen shell.

In a further embodiment, a second channel is connected to the relief chamber and is at least partially arranged in the region of the decoy charge.

In an embodiment, the ignition system includes a first delay means or fuse and first ignitor charge for igniting the camouflage charge and/or comprises a second delay means or fuse and a second ignitor charge for igniting the decoy charge.

In an embodiment, the contact head is connected to a first electrical ignitor such as a priming cap or the like for igniting the ejector charge via contact rings or via a coil.

In an embodiment, a munition is modularly constructed, whereby each module is connected to the ignition system, a first module including the camouflage charge and a second module including the decoy charge.

In a related embodiment, a module has an electrical or pyrotechnical interface with the adjacent module. Where the interface is electrical, the electrical interface leads to at least one second electrical ignitor such as a priming cap or the like. Where the interface is pyrotechnical, the interface can comprise at least one pyrophore such as a slow matchwick or the like.

In an embodiment, the decoy charge is surrounded by a canister.

In an embodiment, the camouflage charge includes a plurality of pressed parts that distribute upon impact of the camouflage charge with the ground.

The present invention is based on the surprising observation that an infrared-masking fog can be produced by a two-component smoke screen shell which, when fired, a decoy charge separates from a camouflage charge. The decoy charge accelerates relative to and takes effect chronologically prior to the camouflage charge. The ballistic paths of the two charges proceed separately from one another from the firing location, but again approached one another at the target to such an extent that a collocation of the spontaneous fog and of the lasting fog occurs, the lasting fog taking effect with a chronological delay. To this end, the pressure released upon deployment of an ejector charge is conducted between the camouflage charge and the decoy charge in order to produce a delay of the camouflage charge and to simultaneously produce an acceleration of the decoy charge. This is enhanced by providing an additional separating charge between the camouflage charge and the decoy charge and/or by adding coefficients of resistance to the camouflage charge and/or to the decoy charge. A lengthened sleeve forms a secondary ejector canister along with a contact head further enables the desired exact trajectories of the camouflage charge and of the decoy charge while also protecting the actual ejector canister.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
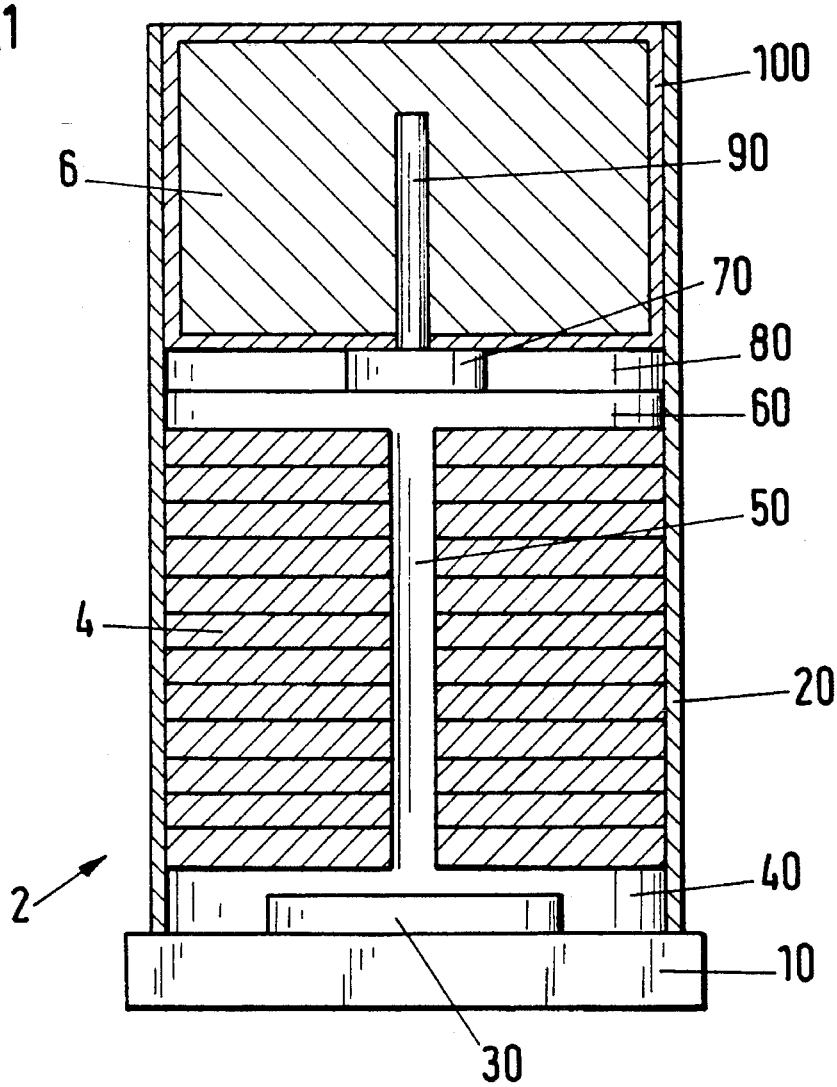
FIG. 1 is a longitudinal sectional view of a smoke screen shell according to the present invention.

By way of example, FIG. 1 illustrates the munition principle of a smoke screen shell 2 of the invention that comprises a camouflage charge 4 and a decoy charge 6.

The housing of the smoke screen shell 2 is essentially canister-shaped, and is formed of a contact head 10 and a sleeve 20 connected thereto. The contact head 10 and sleeve 20 form a secondary ejector canister that is insertable into a traditional ejector canister (not shown) such as, for example, a "Wegmann" canister. The sleeve 20, however, is fashioned longer than traditional ejector canisters, as a result whereof the secondary ejector canister projects beyond a primary ejector canister when it is loaded thereinto.

After the shell is fired by transmission of an ignition pulse to the contact head 10, the decoy and camouflage charges are discharged, whereas the contact head 10 and the sleeve 20 remain in the ejector canister.

The ignition system of the smoke screen shell 2 comprises an ejection charge 30 in an ignition chamber 40 that is connected via a channel 50 extending axially through the camouflage member 4 to a relief chamber 60 between the camouflage charge 4 and the decoy charge 6.

A separating charge 70 in an ignition chamber 80 is also disposed between the camouflage charge 4 and the decoy charge 6. The separating charge 70 is connected, on the one hand, to the relief chamber 60 and, on the other hand, to a second channel 90 that axially extends at least partly into the decoy charge 6.

The decoy charge 6 is arranged inside a canister 100. The sleeve 20 terminates opposite the contact head 10 essentially flush with the decoy charge 6, surrounding all necessary components of the smoke screen shell 2. A seal ring (not shown) can be arranged at a mouth of the smoke screen shell 2 between the canister 100 and the sleeve 20 for sealing the smoke screen shell 2. Also, the canister 100 around the decoy charge 6 can be crimped in against the seal ring with a sleeve projection.

The camouflage charge 4 is preferably fashioned in the form of pressed pieces that distribute upon impact with the ground. The distributed pieces create a larger area of smoke dissemination and can successively generate spot smoke or can output smoke simultaneously.

Figure 2:
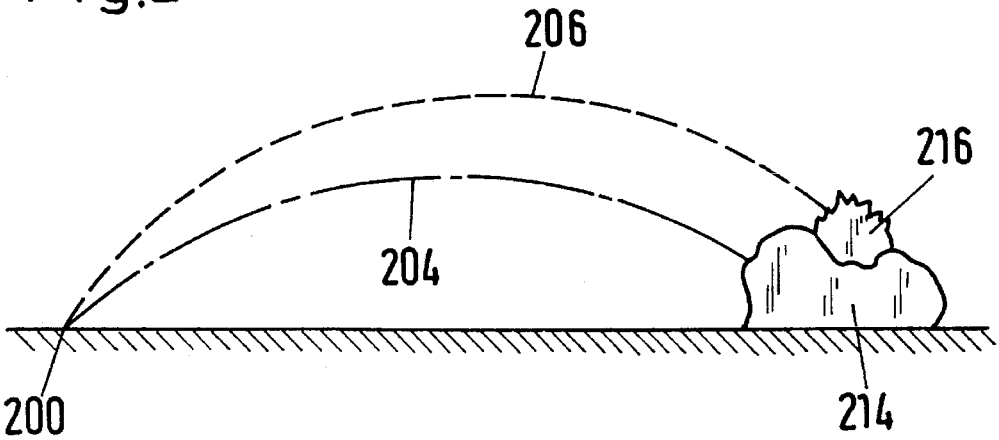
FIG. 2 is a side view of a trajectory path illustrating the functioning of the fired smoke screen shell of FIG. 1.

The functioning principle of the smoke screen shell 2 can be explained with reference to FIG. 2, which shows a firing location 200, a ballistic path 206 of the decoy charge 6 and the location 216 of the spontaneous fog arising after the ignition of the decoy charge 6. Also, a ballistic path 204 of the camouflage charge 4 is illustrated, as well as the location 214 of the lasting fog arising after the ignition of the camouflage charge 4.

Figure 3:
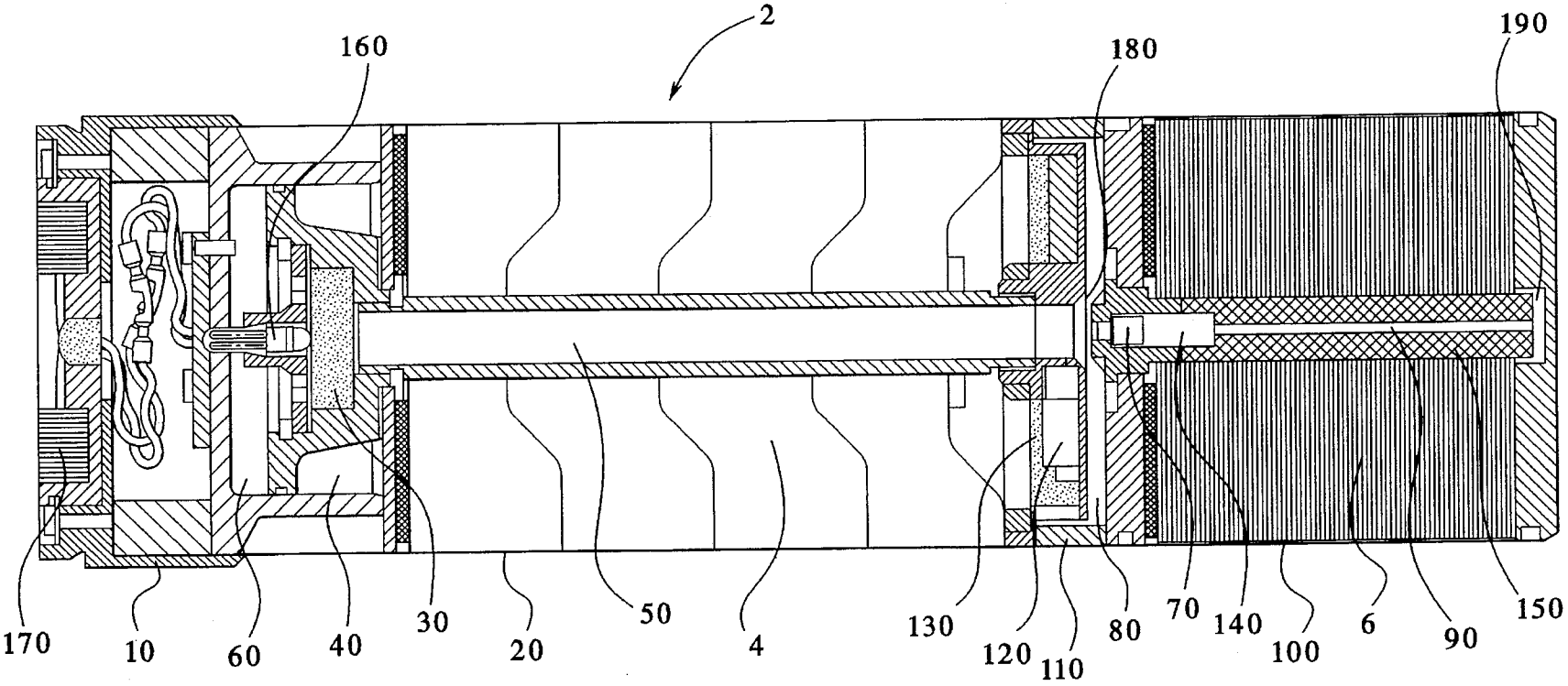
FIG. 3 is a side sectional elevational view of the shell of the present invention having a pyrotechnical interface between modules.

FIG. 3 illustrates ignition components of the shell 2 in greater detail. In an initial step, the smoke screen shell 2 is introduced into an ejector canister (not shown) such as a "Wegmann" canister, whereby two metal bands that proceed along the contact head 10 and form a coil 170 or contact rings, come into contact with the ignition system of the ejector canister, and the sleeve 20 projects from the ejector canister through an end opposite the contact head 10.

For initiating the smoke screen shell 2, an electrical ignition pulse is first supplied to the metal bands of the smoke screen shell 2, as a result whereof the ejection charge 30 is ignited via an electrical ignitor 160.

Figure 4:
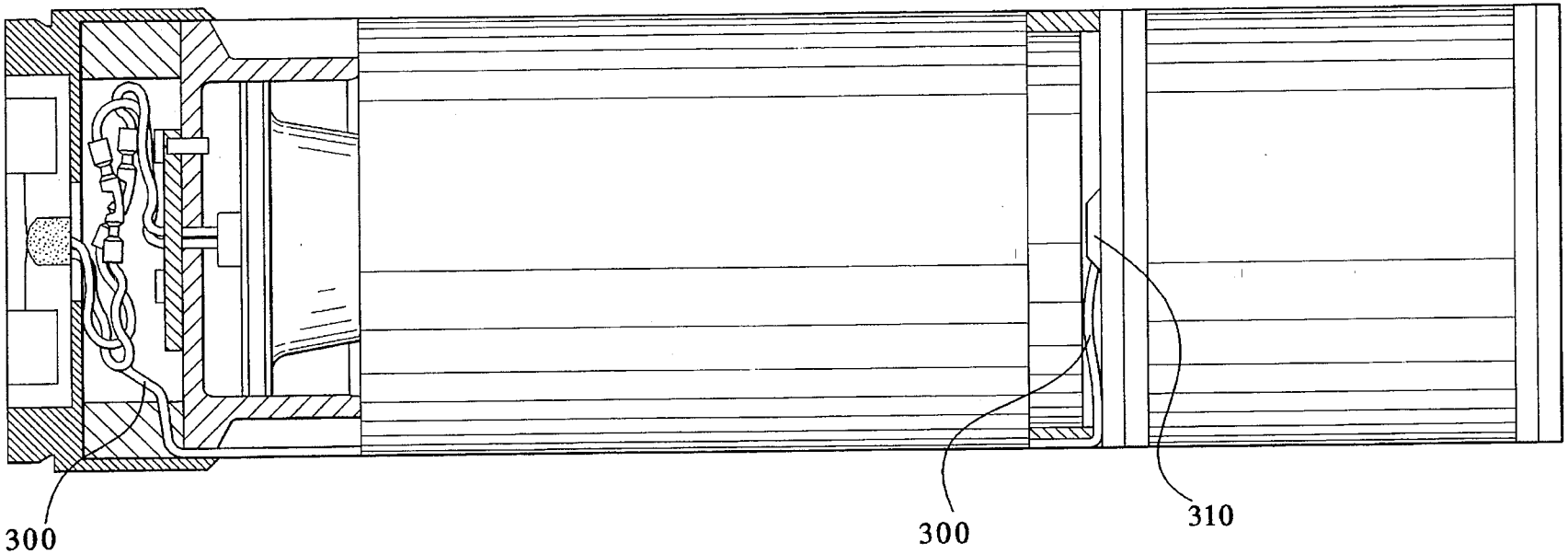
FIG. 4 is a partially sectional side elevational view of an embodiment of the present invention having an electrical interface between modules.

Five events are triggered by the ignition of the ejection charge 30:

a) Upon ignition of the ejection charge 30, propellant gasses arise in the ignition chamber 40 with which the camouflage charge 4 together with the decoy charge 6 are fired from the sleeve 20. The lengthened sleeve 20 thereby acts as a guide and simultaneously promotes the stability of the munition. The ignition system of the ejector canister is not damaged during firing the camouflage charge 4 and decoy charge 6 from the sleeve 20 because, on the one hand, the sleeve 20 forms a crumple zone between the ejector canister and the charges 4, 6 and, on the other hand, the great length of the sleeve 20 effects a reduction of the recoil.

b) The propellant gasses released upon ignition of the ejection charge 30 flow from the ignition chamber 40 through the channel 50 into the relief chamber 60. Thereby, the decoy charge 6 is accelerated and the camouflage charge 4 is simultaneously retarded, this ultimately leading to a separation of the two components upon firing.

c) The propellant gasses also initiate a mechanical, electrical 310, or pyrotechnical ignitor 180 in order to ignite the separating charge 70. As soon as the separating charge 70 is in turn ignited, the pressure in the ignition chamber 80 increases such that the decoy charge 6 is again accelerated relative to the camouflage charge 4.

d) Also, the ignited ejection charge 30 ignites a first, exactly dimensioned delay fuse 120 that leads to a first ignition fission charge 130 in the camouflage charge 4.

e) Finally, a second, exactly dimensioned delay fuse 140 that leads to a second ignition fission charge 150 in the decoy charge 6 is ignited by the ignition of the ejection charge 30. Alternately, as illustrated in FIG. 4, a second electrical ignitor/priming cap 310 ignites the decoy charge 6. The second electrical ignitor/priming cap 310 receives a signal via an electrical connector 300.

After the ignition of the ejection charge 30, the decoy charge 6 departs the sleeve 20 separately and slightly accelerated relative to the camouflage charge 4, so that the camouflage charge 4 follows a slightly shorter trajectory 204 than the trajectory 206 of the decoy charge 6.

In contrast, the sleeve 20 and the contact head 10 do not leave the firing location 200 after the firing of the two components 4, 6 and remain in the ejector canister.

The difference between the two ballistic paths 204, 206 is dependent on the aerodynamic design and dimensions of the components 4, 6, as well as the configuration of the ignition chamber 40, channel 50, relief chamber 60 and the separating charge 70.

The diameter of the first channel 50 is configured correspondingly to volumes of the first ignition chamber 40 and relief chamber 80 such that the decoy charge 6 is accelerated relative to the camouflage charge 4 by a previously determined factor after firing. For instance, it has been found for a 76 mm infrared-masking smoke screen shell, when the ignition chamber 40 between the ejection charge 30 and the camouflage charge 4 has an axial height of approximately 10 mm, the axially proceeding channel 50 centrally arranged over the ejection charge 30 preferably has a minimum diameter of 5mm–10 mm, and the relief chamber 60 preferably has an axial height of 5mm.

Also, the camouflage charge (4) and the decoy charge (6) have respectively different drag coefficients such that the decoy charge (6) flies faster than the camouflage charge (4) after firing. To this end, the camouflage charge (4) can be equipped with a braking mechanism (110) such as extensible wings.

The spontaneous fog 216 arises as soon as the second ignition fission charge 150 is ignited via the second delay fuse 140 (or, alternatively ignited by the second electrical ignitor 310). After a chronological delay, the continuous fog 214 takes effect after ignition of the first ignition fission charge 130 via the first delay fuse 120. In order to achieve the desired ballistic paths 204, 206, the two delay fuses 120, 140 are thereby sized and configured so that the decoy charge 6 is ignited before the camouflage charge 4 and so that the camouflage charge 4 comes to land and disperse its smoke effect under the dispersing smoke of the decoy charge 6. Thereby, a longer-lasting fog 214 slowly proceeds from the ground and collocates with the spontaneous fog 216. Upon impact of the camouflage charge 4 on the ground, its burning pressed pieces distribute, resulting in an increases size of the lasting fog area 214.

Referring to FIG. 3, the munition is modularly constructed, each module being connected to the ignition system 10, 30, 40, 50, 60, 70, 80, 90. A first module includes the camouflage charge and a second module comprises the decoy charge 6. An interface is defined in between modules, the interface being an electrical or pyrotechnical interface to the next module. Where the interface is electrical, it leads to at least one second electrical ignitor such as a priming cap or the like. Where the interface is pyrotechnical, at least one pyrolitic such as a slow match wick or the like.

Before reloading the ejector canister, the secondary ejector canister that consists of the contact head 10 and the sleeve 20 must merely be removed. This removal is easy and leaves the ejector canister clean and undamaged.

Therefore, the present invention achieves the following advantages:

i) the smoke screen shell need only be sealed in the region of the mouth of the secondary ejector canister and in the region of the contact rings thereof;

ii) contamination and damage to the actual ejector canister is avoided, reducing malfunctions and/or accidents when firing the smoke screen shell;

iii) the stability of the munition is assured by the sleeve of the secondary ejector canister, even when a projection beyond a standard ejection canister occurs due to a new type of munition;

iv) the trajectories of the components have improved stability due to the longer guidance of the sleeve; and v) a collocation of spontaneous fog and lasting fog can be achieved even when configured as a small caliber munition.

The two components or modules of the smoke screen shell of the invention can be respectively combined such that they lead to a visual or infrared-masking and/or radar-active smoke screen after ignition, whereby every conceivable combination is possible.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A smoke screen shell comprising:

an ejection charge disposed in an ignition chamber;

a slowly burning camouflage charge for generating a lasting fog, said camouflage charge being disposed adjacently to said ignition chamber;

a rapidly burning decoy charge for generating a spontaneous fog, said decoy charge being disposed adjacently to said camouflage charge opposite said ignition chamber;

an ignition system for igniting said ejection charge to discharge said camouflage charge and said decoy charge;

a relief chamber disposed between said camouflage charge and said decoy charge; and a channel extending between said ignition chamber and said relief chamber;

wherein pressure arising upon ignition of said ejection charge, via said channel and relief chamber, causes a separation of said decoy charge from said camouflage charge and causes a relative difference between a trajectory of said decoy charge and a trajectory of said camouflage charge such that said decoy charge and said camouflage charge land proximally to one another at a target location to such an extent that a collocation of said spontaneous fog and of said lasting fog approaching said former chronologically retarded, said decoy charge being deployed in the air after firing prior to deployment of said camouflage charge.

2. The smoke screen shell according to claim 1, wherein a diameter of said first channel corresponds to volumes of said first ignition chamber and said relief chamber such that said decoy charge is accelerated relative to said camouflage charge at a previously determined rate after firing.

3. The smoke screen shell according to claim 1, further comprising:

a separating charge between said camouflage charge and said decoy charge, said separating charge being ignitable such that it accelerates said decoy charge relative to said camouflage charge.

4. The smoke screen shell according claim 1, wherein said camouflage charge and said decoy charge have correspondingly different drag coefficients such that said decoy charge flies faster than said camouflage charge after firing.

5. The smoke screen shell according to claim 4, wherein said camouflage charge has a braking mechanism.

6. The smoke screen shell according to claim 1, further comprising:

a contact head; and an elongated sleeve connected to said contact head, whereby said contact head and said sleeve are insertable into a primary ejector canister, forming a secondary ejector canister from which said decoy charge and said camouflage charge can be fired after transmission of an ignition pulse to said contact head, leaving said contact head and said sleeve remaining in said primary ejector canister.

7. The smoke screen shell according to claim 6, wherein said sleeve terminates essentially with said decoy charge at its end lying opposite said contact head, surrounding all necessary components of said smoke screen shell.

8. The smoke screen shell according to claim 1 wherein a second channel extends from said second ignition chamber and at least partially into said decoy charge.

9. The smoke screen shell according to claim 1, wherein said ignition system includes a first delay fuse and a first ignition fission charge for igniting said camouflage charge and a second delay fuse and a second ignition fission charge for igniting said decoy charge.

10. The smoke screen shell according to claim 1 wherein said contact head is connected to a first electrical ignitor for igniting said ejection charge via contact rings or a coil.

11. The smoke screen shell according to claim 1, wherein said shell is modularly constructed, each module being connected to said ignition system, a first of said modules comprising said camouflage charge, and a second of said modules comprising said decoy charge.

12. The smoke screen shell according to claim 11, further comprising an interface in each module for igniting said module.

13. The smoke screen shell according to claim 12, wherein the interface is electrical, said electrical interface leading to at least one second electrical ignitor such as a priming cap or the like.

14. The smoke screen shell according to claim 12, wherein said interface is pyrotechnical, comprising at least one pyrolitic such as a slow matchwick or the like.

15. The smoke screen shell according to claim 1, further comprising a canister surrounding said decoy charge.

16. The smoke screen shell according to claim 1, wherein characterized in that said camouflage charge is fashioned as pressed pieces that distribute upon impact of said camouflage charge on a terrain.

17. A smoke screen shell comprising:

a sleeve having a contact head with an ejector charge in an ignition chamber;

a first smoke charge positioned in said tube adjacently to said ejector charge; and a second smoke charge positioned in said tube adjacently to said first smoke charge, said first and second smoke charges being separated by a relief chamber, said relief chamber being in fluid communication with said ignition chamber;

wherein said first and second smoke charges are projected from said tube upon ignition of said ejector charge, pressure in said relief chamber from said ejector charge causing a separation and acceleration difference between said first and second smoke charges.

18. The smoke screen shell according to claim 17 wherein said first and second smoke charges are ignited to disperse smoke, said first smoke charge igniting subsequent to ignition of said second smoke charge, said accelleration difference being such that said first and second charges land within a sufficient proximity of one another that smoke produced by the respective charges mixes together.

19. A smoke screen shell comprising:

a first smoke charge;

a second smoke charge;

an ejection charge effective to eject said first and second smoke charges from an ejection tube, said ejection charge being positioned in a first ignition chamber; and a relief chamber disposed between said first and second smoke charges in communication with said first ignition chamber so that said relief chamber receives pressure from an ignition of said ejection charge, said pressure resulting a longer trajectory of said first smoke charge than said second smoke charge.

20. A smoke screen shell according to claim 19 further comprising:

a separating charge adjacent said relief chamber, said separating charge igniting generally simultaneously with said ejection charge to further increase pressure in said relief chamber.

* * * * *